United States Patent [19]

Maglica

[11] 4,286,311

[45] Aug. 25, 1981

[54] FLASHLIGHT

[76] Inventor: Anthony Maglica, 219 Armsley Sq., Ontario, Calif. 91762

[21] Appl. No.: 968,468

[22] Filed: Dec. 11, 1978

Related U.S. Application Data

[63] Continuation-in-part of Ser. No. 894,492, Apr. 7, 1978, abandoned.

[51] Int. Cl.[3] ..... F21L 7/00

[52] U.S. Cl. ..... 362/205; 200/153 J; 200/64; 362/187; 362/202

[58] Field of Search ..... 362/187, 188, 158; 202/205; 200/64, 153 J, 328, 241, 242

[56] References Cited

U.S. PATENT DOCUMENTS

| | | | |
|---|---|---|---|
| Re. 29,047 | 11/1976 | Brindley | 362/205 |
| 1,823,762 | 9/1931 | Rathmann | 362/188 |
| 2,097,222 | 10/1937 | Tompkins et al. | 362/187 |
| 2,212,103 | 8/1940 | Rothenberg et al. | 362/188 |
| 2,229,486 | 1/1941 | Barash et al. | 362/205 |
| 2,945,111 | 7/1960 | McCormick | 200/64 X |
| 3,694,603 | 9/1972 | Congelliere | 200/64 |
| 4,114,187 | 9/1978 | Uke | 362/158 |

*Primary Examiner*—Harold J. Tudor
*Attorney, Agent, or Firm*—Paul L. Gardner

[57] ABSTRACT

A rugged, heavy duty flashlight which is hermetically sealed to prevent intrusion of moisture and dirt. A manually operable electric switch is provided having a rotary contact to complete the battery circuit to the bulb. When the switch is actuated the rotary contact is moved axially to engage stationary contacts and is then rotated to wipe against such stationary contacts to clean the contact surfaces. The flashlight is readily adjustable to change from a narrow concentrated light beam to a broad scattered beam.

5 Claims, 12 Drawing Figures

FIG.10.
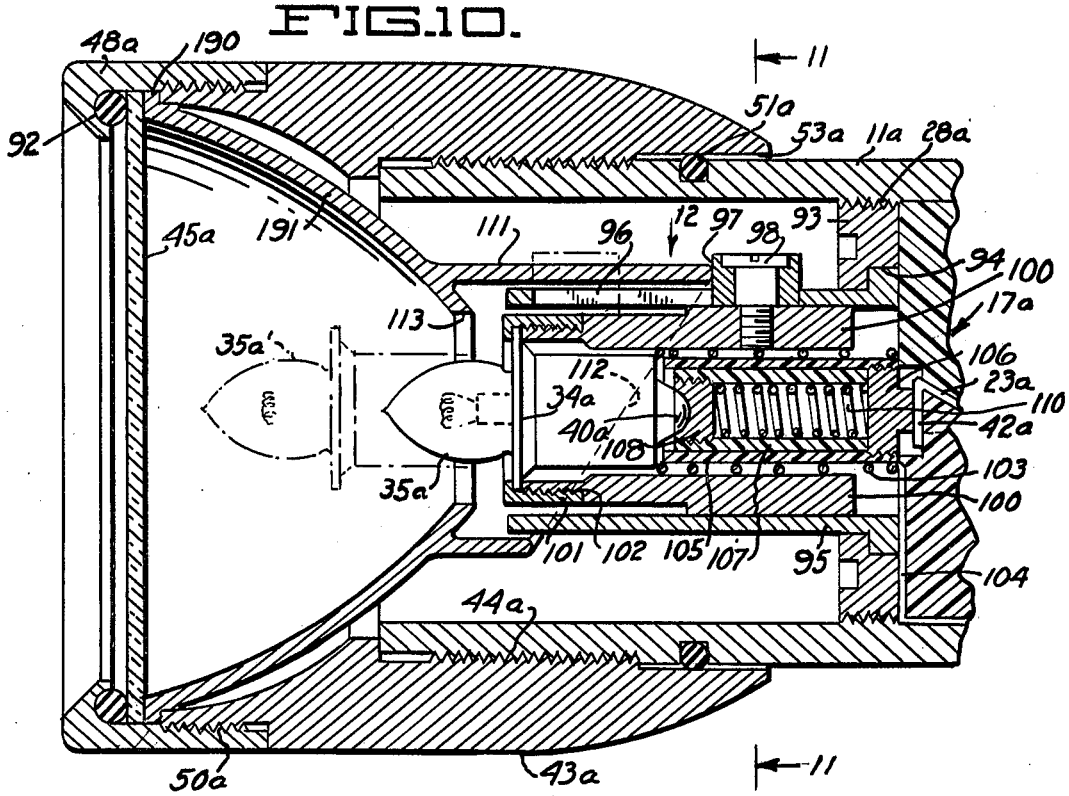
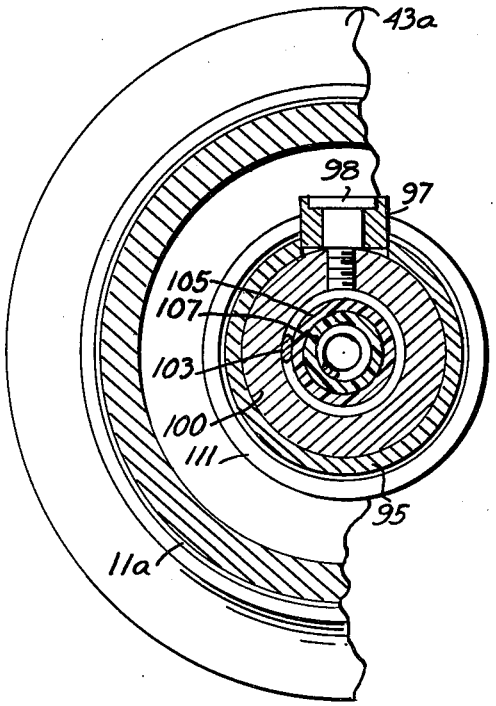
FIG.11.
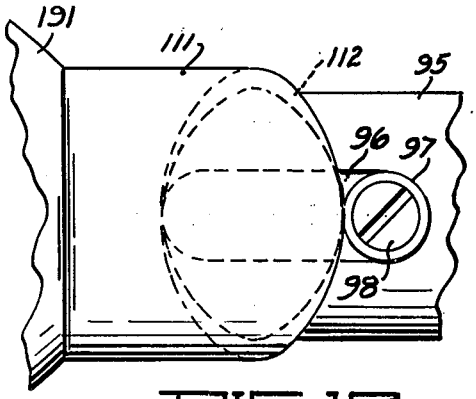
FIG.12.

FLASHLIGHT

This application is a continuation-in-part of my copending application Ser. No. 894,492, filed Apr. 7, 1978 now abandoned and entitled "FlashLight".

BACKGROUND OF THE INVENTION

1. Field of the Invention

This invention relates to portable battery operated devices and has particular reference to portable flashlights.

2. Description of the Prior Art

Heretofore, flashlights of the above type have had a tendency to periodically malfunction due principally to build-up of oxidation and/or dirt on the electrical contacts, particularly the switch contacts, whereby increasing resistance in the battery circuit to a point where the flashlight bulb produces diminished illumination or even no illumination at all. This condition is aggrevated in cases where moisture can enter into the interior of the flashlight causing corrosion and therefore abnormal electrical resistance of the switch contacts and other contacts in the battery circuit.

SUMMARY OF THE INVENTION

It therefore becomes a principal object of the present invention to provide a flashlight having means for removing oxidation, dirt or the like from the switch contacts.

Another object is to provide a flashlight having a hermetically sealed interior.

Another object is to provide a flashlight having a readily removable and replaceable switch assembly.

Another object is to provide a hermetically sealed flashlight having an improved means for changing the focus of the light thereof between a narrow beam and a broad beam.

A further object is to provide a rugged and durable flashlight which will withstand extreme handling and abuse.

According to the present invention, a portable battery operable flashlight is provided having a rotary switch contact which is rotated relative to mating stationary contacts each time the switch is actuated whereby to rub or wipe off any dirt and products of oxidation or corrosion between the contacts. Moisture excluding elastomeric seals are provided between separable and movable parts of the flashlight to hermetically seal against intrusion of moisture and dirt.

According to another aspect of the invention, a focusable light reflector is provided which is axially movable relative to the bulb of the flashlight. The reflector is carried by a head member which is screw threaded on the flashlight casing. An elastomeric seal hermetically seals against entrance of moisture or dirt between the head member and the casing and also acts to frictionally lock the head member and the reflector in different adjusted positions. In a modified form, the head member carries a camming device which is capable, when the head member is rotated through less than one revolution, of fully adjusting the bulb axially to change the light from a narrow or spot beam to a broad or flood beam and vice versa.

Due to its rugged construction, the flashlight may be used by policemen as a billy club without damage thereto.

BRIEF DESCRIPTION OF THE DRAWING

The manner in which the above and other objects of the invention are accomplished will be readily understood on reference to the following specification when read in conjunction with the accompanying drawing, wherein:

FIG. 10 is an enlarged longitudinal sectional view through the head portion of a modified form of my invention.

FIG. 11 is a transverse sectional view, partly broken away, and taken along line 11—11 of FIG. 10.

FIG. 12 is a fragmentary plan view taken in the direction of the arrow 12 in FIG. 10.

DESCRIPTION OF THE PREFERRED EMBODIMENT

Figures 1, 2, 3, 4, 5, 6, 7, 8, 9:
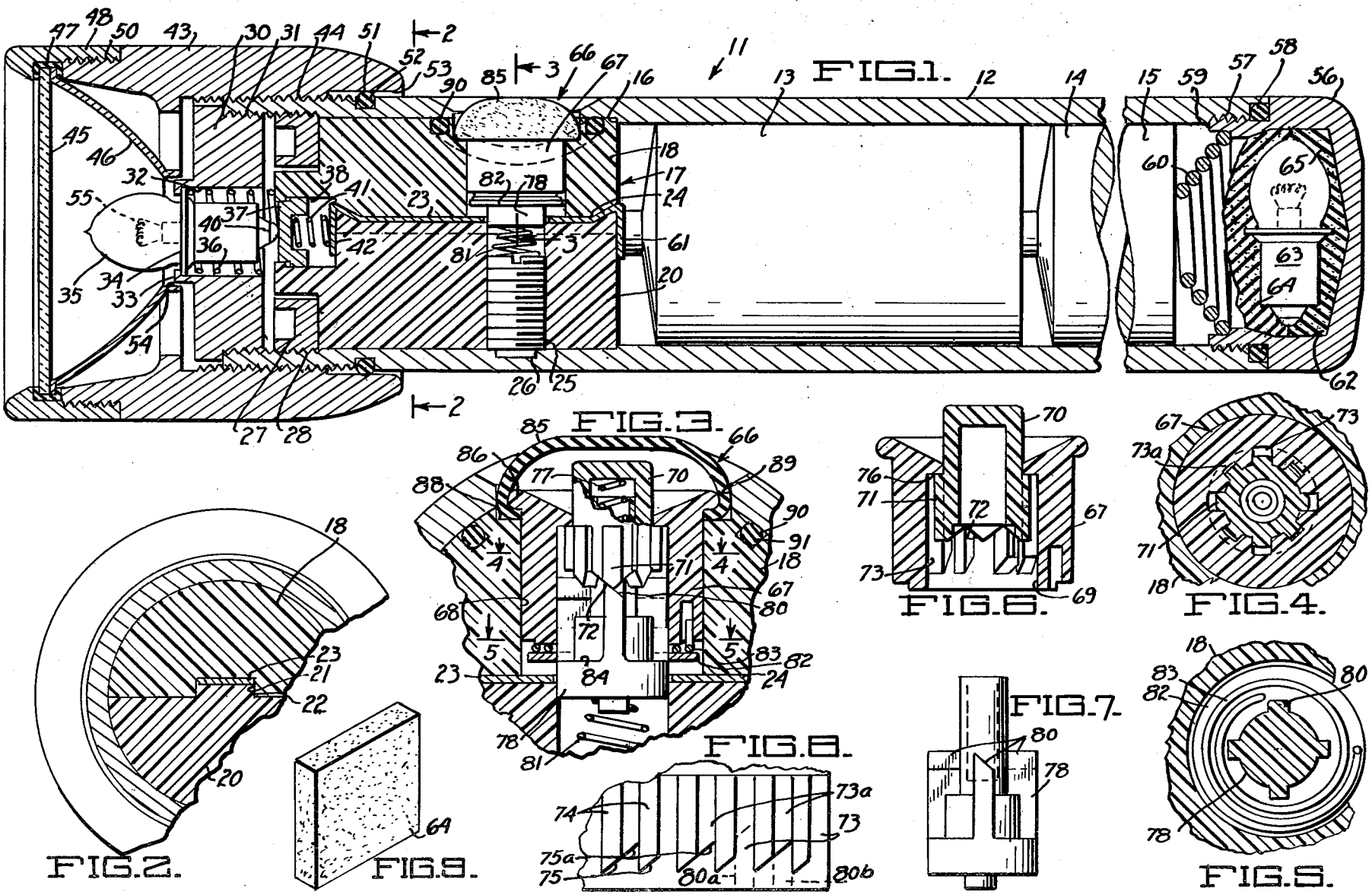
FIG. 1 is a longitudinal sectional view of the flashlight embodying a preferred form of the present invention.
FIG. 2 is a transverse sectional view, partly broken away, and taken along line 2—2 of FIG. 1.
FIG. 3 is an enlarged sectional view through the switch assembly and is taken along line 3—3 of FIG. 1.
FIG. 4 is a sectional plan view through the upper part of the switch assembly and is taken along the line 4—4 of FIG. 3.
FIG. 5 is a sectional plan view taken through the lower part of the switch assembly and is taken along the line 5—5 of FIG. 3.
FIG. 6 is a sectional detail view of the switch guide body and the drive plunger for the indexing member.
FIG. 7 is a detailed sectional view of the indexing member.
FIG. 8 is a developed view showing the interior of the switch guide body, partly broken away.
FIG. 9 is a perspective view of one of the resilient pads for supporting an extra bulb in the flashlight casing.

Referring to the drawing, the flashlight is generally indicated at 11 and comprises a tubular casing 12, preferably of aluminum, and having a length to contain a selected number of batteries, i.e. 13, 14 and 15. That is, the casing 12 may be made in different lengths to receive a desired number of batteries, ranging from two to seven or more.

The casing 12 is counterbored at 16 to receive a switch housing 17 comprising nested upper and lower semi-cylindrical housing parts 18 and 20, respectively, preferably of a plastic having relatively high dielectric qualities. A groove 21, FIG. 2, in the upper housing part 18 receives a tongue 22 on the lower housing part 20 to clamp a pair of longitudinally aligned, spaced conductor strips 23 and 24 therebetween. The strips 23 and 24 are preferably of copper.

The housing part 20 is locked in properly oriented position in the casing 12 by a set screw 25 threaded therein and having a projection 26 extending into a mating socket formed in the wall of the casing 12. Also, a retainer ring 27 is screw threaded at 28 in the casing 12 and serves to clamp the switch housing 17 in place against the rear end of the counterbore 16.

A bulb holder 30, preferably of aluminum, is also screw threaded at 31 in the casing 12 and has a central bore 32 therein terminating in an inwardly extending flange 33 to receive the contact flange 34 of a light bulb or lamp 35. The latter is held in place against the flange 33 by a spring 36 compressed between the flange 34 and the switch housing 17 to establish a circuit connection between the base of the bulb 35 and the casing 12.

A metal contact plunger 37 is slidably mounted in a bore 38 formed in the upper and lower switch housing parts 18 and 20 and is yieldably held in engagement with a central contact 40 of the bulb 35 by a spring 41 compressed between the plunger 37 and a bent-over ear 42 on the forward end of the conductor strip 23 to establish a circuit connection between the bulb and the conductor strip 23. Contact 40 and flange 34 are electrically connected to opposite ends of the bulb filament 55.

A tubular head 43 is screw threaded over the casing 12 at 44 and carries a transparent window 45 of plastic or the like and a generally parabolic reflector 46. The latter elements are encased around their outer edges in an annular elastomeric seal 47 of U-shaped cross-section which is clamped between the head 43 and a face cap 48 screw threaded on the head at 50. The seal 47 prevents the entrance of moisture and dirt.

An O-ring 51 of elastomeric material is fitted within a groove 52 formed in the barrel casing 12 and frictionally engages a smooth bore section 53 formed in the head 43 to form a hermetic seal between the casing 12 and head 43. Such O-ring 51 also frictionally holds the head in any adjusted position on the casing 12.

It will be noted that the reflector 46 has a central opening 54 which is larger than the bulb 35 so that the head 43 may be screwed in or out relative to the casing 12 to move the reflector 46 axially relative to the bulb. Thus, as the focal point of the parabolic reflector 46 is moved forwardly of the bulb filament 55 the light beam becomes narrowed or concentrated for long distance observation or the like. On the other hand, when the focal point of the reflector is moved rearwardly of the bulb filament 55 the beam is broadened to provide a flood light pattern for lighting large areas, such as the interior of a room.

A tail cap 56, preferably of aluminum, is screw threaded at 57 in the rear end of the casing 12 and an O-ring 58 is clamped between the tail cap and the casing to form a hermetic seal at this juncture. A conical compression spring 60 is compressed between the cap 56 and the negative terminal of the rearmost battery 15 to yieldably hold the stack of batteries in electrical contact with each other and to maintain the positive terminal 59 of the foremost battery, i.e. 13, in electrical contact with a bent-over ear 61 on the conductor strip 24, thus establishing an electric circuit between the strip 24 and the casing 12.

The tail cap 56 is hollowed out at 62 to receive an extra bulb 63 which is sandwiched between two pads 64 and 65 of sponge rubber or the like to prevent breakage of the bulb in the event the flashlight should be dropped or struck a heavy blow. One such pad 64 is shown in FIG. 9.

It will be noted that the cap 56 presents an annular shoulder 59 which limits rearward axial movement of the batteries 13 to 15 in the event the flashlight is subjected to a shock or inertial load tending to drive the batteries rearward against the action of spring 60. Thus, the battery 15 can not crush the extra bulb 63, and the soft pads 64 and 65 prevent the bulb 63 from striking against the cap 56 or spring 60.

A flashlight switch is generally indicated at 66 (FIGS. 1 and 3) and comprises an annular switch guide body 67 (see also FIGS. 4 and 6), preferably of plastic, suitably removably secured as by an adhesive within a bore 68 formed in the upper switch housing part 18 in axial alignment with the set screw 25 and with an opening 89 in the casing 12. A hollow drive plunger 70 is slideable endwise in the body 67 and is provided with eight external splines 71 terminating in lower triangular end teeth 72. The splines are slideably endwise in interspersed grooves 73 and **73*a* (see also FIGS. 4 and 8) in the guide body 67. The bottoms of grooves 73 are coextensive with a cylindrical bore 69 formed in the lower end of the guide body 67 but the grooves 73*a* are shallower and terminate at their lower ends in inclined edges 75*a*. Interspersed between such grooves 73 and 73*a* are splines 74 terminating at their lower ends in inclined edges 75. As shown in FIG. 8, the inclined edges 75 of alternate splines 74 are coextensive with adjacent inclined edges 75*a* formed below the grooves 73*a***.

Normally, the plunger 70 is held in its upper illustrated position, wherein the upper ends of the splines 71 limit against a shoulder 76 on the guide body 67, by a compression spring 77 extending between the plunger and an indexing member 78 (see also FIG. 7). Member 78 has four equally spaced upwardly extending teeth 80 which are held in engagement with certain of the triangularly shaped teeth 72 on plunger 70, as seen in FIG. 3, by a spring 81 compressed between the member 78 and set screw 25. The upper ends of the teeth 80 are inclined in the same direction as the inclined edges 75 of the splines 74 and are also engageable with such edges 75 as will be described subsequently.

A disc shaped contact 82, preferably of brass, (see also FIG. 5) is slideably splined to the teeth 80 on indexing member 78 to permit vertical axial movement of the contact 82 relative to the indexing member 78 but constraining the contact to rotate with the indexing member. Normally, a spiral compression spring 83, interposed between the drive body 67 and the contact 82, and of less strength than spring 81, holds the contact against a shoulder 84 formed on member 78.

A bowl shaped flexible diaphragm 85 of rubber or similar elastomeric material is positioned in the opening 87 in casing 12 and is clamped along its outer edge between a flange 86 on the guide body 67, and a counterbored seat 88 formed in the upper switch housing part 18 to hermetically seal the switch against intrusion by moisture or dirt while permitting finger depression of the plunger 70 through the diaphragm to actuate the same.

An O-ring 90 of elastomeric material is fitted in a groove 91 formed in the switch housing part 18 and surrounding the switch guide body 67. The O-ring 90 hermetically seals against the inner periphery of the casing 12.

The switch 66 is illustrated in its open condition in which case the teeth 80 of index member 78 are located within aligned ones of the slots 73 (FIG. 8) as indicated by the dot-dash line representation **80*a* of one of such teeth. Thus, the indexing member 78 is allowed to be raised by spring 81 to its uppermost position shown in FIG. 3 wherein each of its teeth 80 engage a respective tooth 72 of plunger 70. Thus, the shoulder 84 of the index member 78 raises the contact disc 82 out of bridging engagement with the conductor strips 23 and 24** to hold the battery circuit open.

When the plunger 70 is depressed by finger pressure acting through the diaphragm 85, it likewise depresses the index member 78, causing the teeth 80 of the latter to slide downwardly along the respective grooves 73 until the contact disc 82 engages the conductor strips 23 and 24. Further depression of the plunger 70 against the action of spring 81 until the teeth 80 pass below the inclined edges 75 enables the teeth 72 to cam the teeth 80 and index member 78 to the right in FIG. 8 (left in FIG. 3) to move each tooth somewhat to the right of its position 80*a*. During this movement, the contact disc 82 is yieldably held in engagement with the conductor strips 23 and 24 by spring 83 and as it is partially rotated by the index member 78 it wipes or rubs against the strips to remove any products of oxidation or corrosion, leaving the contact surfaces clean to present a minimum resistance to the battery current. As the plunger 70 is released from finger pressure, it is returned to its upper position by spring 77 and index member 78 is forced upward by spring 81 causing teeth 80 to cam along the inclined edges 75 and 75*a* of the adjacent splines 74 until they reach their intermediate upper positions indicated by the dotted lines 80*b* in FIG. 8. Thus, the contact disc will be further rotated somewhat to rub against the conductor strips 23 and 24. When the teeth 80 come to rest in their intermediate positions, i.e. 80*b* against the inclined edges 75*a*, the contact disc 82 will still be held in bridging engagement with the conductor strips 23 and 24 by spring 83.

When the plunger 70 is again fully depressed, the index member 78 will again be depressed, and at the bottom of its stroke, the teeth 80 will again be partly rotated to the right in FIG. 8 so that when the plunger 70 is released they will cam along the inclined edges 75 of overlying splines 74 to move into the grooves 73 and thus permit the index member 78 to be moved fully upward into its position shown in FIG. 3, again carrying the contact disc 82 out of engagement with the conductor strips 23 and 24.

In the event it is desired to cause a rapid flashing of the light for signalling or similar purposes, the plunger 70 is repetitively depressed only part way, until the index member 78 carries the contact disc 82 into engagement with the conductor strips 23 and 24 but before the teeth 80 fully disengage from the grooves 73. Upon release of the plunger 70 the index member 78 will rise under the action of spring 81 to return the contact 82 upward to break the battery circuit.

Although a tungsten filament type bulb 35 is illustrated, the latter may be readily removed by completely unscrewing the head 43 and the bulb holder 30 and may be replaced by a bulb of the halogen type. Likewise, the batteries, i.e. 13, 14 and 15, may be readily removed by unscrewing the tail cap 56 and may be replaced by suitable batteries capable of energizing such halogen type bulb.

Due to the relatively high temperatures developed by halogen type bulbs, the housing parts 18 and 20 are preferably formed of heat resistant plastic.

The switch housing 17 may also be readily removed and replaced by suitably removing the switch assembly 66, including switch guide body 67 and then unscrewing the retainer nut 27 and then the set screw 25, permitting the housing parts 18 and 20 to be slid out through the forward end of the casing 12.

Since halogen type bulbs develop considerable heat, i.e. in the neighborhood of 400° F., and since the aluminum parts readily transfer such heat to the exterior, the flashlight can equally well be used as a hand warmer.

In view of the wiping action of the contact disc 82, the contact surfaces are always maintained clean and there is therefore no necessity of providing expensive non-oxidizing precious metals for such contacts.

DESCRIPTION OF THE ALTERNATE EMBODIMENT

FIGS. 10 to 12 illustrate a modified form of the head portion of the flashlight, such form facilitating adjustment of the flashlight to project either a narrow spot beam or a broad flood beam or any intermediate type beam by merely turning the head through one-half revolution or less.

Referring to the FIGS. 10 to 12, those parts which are similar to the parts found in FIGS. 1 to 9 will be identified by similar numerical reference characters.

A tubular head member 43*a* is screw threaded at 44*a* onto one end of the casing 11*a* and has a smooth bore section 53*a* which frictionally engages over an elastomeric O-ring 51*a* mounted in a groove in the casing 11*a* to hermetically seal the interior of the flashlight at that point and to yieldably hold the head 43*a* in any adjusted position.

A transparent window 45*a* and flanged rim 190 of a generally parabolic reflector 191 are clamped to the forward end of the head member 43*a* by an annular face clamp 48*a* which is screw threaded to the head member 43*a* at 50*a*. The annular clamp 48*a* clamps an elastomeric O-ring 92 against the window 45*a* to hermetically seal the window 45*a*.

A retainer ring 93 is screw threaded at 28*a* within the casing 11*a* to retain the switch housing 17*a* within the casing 11*a*. The ring 93 has a counterbore socket 94 therein to center and secure a guide sleeve 95 coaxially of the casing 11*a*. The sleeve 95 has a longitudinally extending guide slot 96 formed in the wall thereof (see also FIG. 12) to guide a cam follower roller 97 along the slot. The roller 97 is rotatably mounted on a bearing screw 98 which is threadably attached to a cylindrical bulb carrier sleeve 100 slidably mounted within the sleeve 95.

A light bulb 35*a* having a circular contact flange 34*a* is secured to the forward end of the sleeve 100 by a retainer cap 101 which is screw threaded over the sleeve 100 at 102 to clamp the flange 34*a* against the forward end of the sleeve 100.

A compression spring 103 is fitted within the sleeve 100 and is compressed between the base of the bulb 35*a* and the switch housing 17. One end 104 of the spring 103 extends radially outwardly to engage the interior of the casing 11*a* and thus establish an electrical contact between the casing 11*a* and the bulb 35*a*.

A guide sleeve 105 of plastic or the like insulating material is slidably fitted within the compression spring 103 and has a contact tip 106 of metal threadably attached thereto to engage a bent-over ear 42*a* of conductor strip 23*a*. A contact sleeve 107, also of plastic or like insulating material, is slidably fitted within the sleeve 105 and carries a metallic socket element 108 which is screw threaded thereto and which is held in electrical contact with the central contact 40*a* of the bulb 35*a* by a spring 110 which is compressed between the tip 106 and the socket element 108, the spring 110 forming the electrical connection between the tip 106 and the socket element 108.

A tubular or annular formation 111 is formed integrally with the rear end of the reflector 191 and extends concentrically over the guide sleeve 95. The formation 111 has an inclined end cam surface 112, against which the cam follower roller 97 is yieldably held by the spring 103. The reflector 191 has a central opening 113 therein through which the cap 101 and sleeve 100 may extend.

Accordingly, when the head member 43*a* is rotated in either direction from its full line illustrated position shown in FIGS. 10 and 12, the cam surface 112 will permit the spring 103 to move the lamp bulb 35*a* from its full line illustrated position where it projects a relatively narrow light beam of light to its dotted line position 35*a'* wherein it projects a relatively broad or flood beam of light. This whole traverse of the light bulb 35*a* to the opposite extremes of its travel is accomplished with only one-half revolution of the head member 43*a*. During such travel of the bulb 35*a*, the spring 110 expands and contracts, causing the sleeve 107 to slide lengthwise along the tube 105 to always maintain the bulb contact 40*a* in electrical connection with the conductor strip 23*a* as the bulb is moved back and forth.

It will be noted that the cam surface 112 is formed to generate a harmonic movement of the bulb 35*a* upon rotation of the member 43*a* in either direction from its position shown in FIGS. 10 and 12. However, such cam surface 112 may, if desired, be formed otherwise to generate other types of camming movement.

Although the head member 43*a* will partake of a slight axial movement during rotation thereof by virtue of its screw threaded connection 44*a* with the casing 11*a*, this will be of a minor consequence. On the other hand, in order to disassemble the flashlight, the head member 43*a* may be unthreaded completely from the casing 11*a*.

It will be obvious to those skilled in the art that many variations may be made in the exact construction shown without departing from the spirit and scope of this invention.

I claim:

1. A flashlight comprising:

a generally cylindrical casing having longitudinal axis, a forward end portion and a rear end portion;

a reflector support member rotatably mounted on said forward end portion of said casing;

a reflector structure secured to said reflector support member;

said reflector structure having a central opening adapted to receive a light bulb therethrough, a reflector surface extending axially forwardly and radially outwardly from said opening and a generally tubular cam structure extending rearwardly of said opening and terminating in a rear cam edge which lies substantially in a plane which is inclined relative to the longitudinal axis of said cylindrical casing;

a guide sleeve mounted within said casing; means defining an axially extending guide slot in a portion of said guide sleeve;

a bulb carrier sleeve slidably disposed in said guide sleeve for axial movement relative thereto, said bulb carrier sleeve having a forward end portion;

a light bulb member removably secured in the forward end portion of said bulb carrier sleeve;

a cam follower roller secured to said bulb carrier sleeve and extending radially outwardly therefrom; said cam follower roller being slidably disposed in said axially-extending guide slot in said guide sleeve so as to permit axial sliding movement of said cam follower roller and bulb carrier sleeve and light bulb member relative to said guide sleeve;

a switch housing mounted within said casing;

a conductor strip mounted within said switch housing;

an outer coiled compression spring disposed between said switch housing and said light bulb member for urging said light bulb member forwardly in said central opening of said reflector structure; said cam follower roller on said bulb carrier sleeve in which said light bulb member is mounted functioning, in conjunction with said guide slot in said guide sleeve, to define the forward and rearward limits of axial movement of said light bulb structure; an exterior guide sleeve disposed within said coiled compression spring; said exterior guide sleeve having a forward end disposed adjacent to said light bulb member and a rear end portion disposed adjacent to said switch housing;

a contact member secured in said rear end portion of said exterior guide sleeve;

an interior guide sleeve slidably disposed within said exterior guide sleeve; said interior guide sleeve having a forward end portion and a rear end portion;

a contact element secured in said forward end portion of said interior guide sleeve; said conductive contact element being adapted to receive a contact portion of said light bulb structure;

an interior compression spring disposed within said interior guide sleeve and extending between said contact member in the rear end portion of said guide sleeve and said contact element in the forward end portion of said interior guide sleeve to establish electrical contact between said conductor strip in said switch housing and said light bulb member;

a pair of spaced conductor strips disposed within said casing; said spaced conductor strips including a forward conductor strip and a rear conductor strip in substantial alignment with one another;

a generally radially extending, generally tubular guide body disposed in said casing; said guide body having an interior peripheral wall;

a drive plunger slidably and rotatably disposed in said guide body; said drive plunger extending generally radially relative to the longitudinal axis of said casing;

said drive plunger being of generally tubular configuration, and having a closed outer end;

a plurality of circumferentially-spaced spline members formed around the exterior of said drive plunger; said spline members having teeth formed on the lower ends thereof; said teeth having inclined edges;

an indexing member disposed within said casing and extending generally radially relative to the longitudinal axis of said casing; said indexing member being in substantial alignment with said drive plunger and being located generally radially inwardly therefrom;

said indexing member including a base portion having a plurality of circumferentially-spaced upstanding teeth thereon adjacent the periphery of said base portion;

said teeth on said indexing member and said teeth on the lower portions of said spline members of said drive plunger having cooperating inclined surfaces such that radially inward movement of said drive plunger relative to said indexing member first move said indexing member radially inward and thereafter will cause said inclined teeth edges to engage one another and create rotational movement of said indexing member relative to said drive plunger;

a generally annular contact member splined to said indexing member so as to be slidable relative thereto in a radial direction relative to said longitudinal axis of said casing, but confined for rotational movement with said indexing member;

said contact member being adapted to engage portions of each of said spaced conductor strips so as to establish electrical connection therebetween;

means defining circumferentially-spaced grooves in said interior wall of said guide body for receiving said teethed spline members on said drive plunger and said teeth on said indexing member;

means defining circumferentially-spaced, inclined ramp portions on said interior peripheral wall of said guide body; said circumferentially spaced grooves in the interior peripheral wall of said guide body functioning to confine said drive plunger to radial sliding movement relative to said longitudinal axis of said casing, and to confine said indexing member to radial sliding movement until the teeth of said indexing member clear said inclined ramp portions, whereupon further radially inward movement of said drive plunger will cause rotational movement of said indexing member and the annular contact member splined thereto;

heavier compression spring means disposed in said casing and urging said indexing member towards said drive plunger;

lighter compression spring means disposed between said closed upper end of said drive plunger and said indexing member to urge said drive plunger away from said indexing member; and cooperating abutment means on said guide body and said drive plunger for limiting outward radial movement of said drive plunger relative to said guide body.

2. A flashlight comprising:

a generally cylindrical casing having longitudinal axis, a forward end portion and a rear end portion;

a reflector support member rotatably mounted on said forward end portion of said casing;

a reflector structure secured to said reflector support member;

said reflector structure having a central opening adapted to receive a light bulb therethrough, a reflector surface extending axially forwardly and radially outwardly from said opening and a generally tubular cam structure extending rearwardly of said opening and terminating in a rear cam edge which lies substantially in a plane which is inclined relative to the longitudinal axis of said cylindrical casing;

a guide sleeve mounted within said casing; means defining an axially extending guide slot in a portion of said guide sleeve;

a bulb carrier sleeve slidably disposed in said guide sleeve for axial movement relative thereto, said bulb carrier sleeve having a forward end portion;

a light bulb member removably secured in the forward end portion of said bulb carrier sleeve;

a cam follower roller secured to said bulb carrier sleeve and extending radially outwardly therefrom; said cam follower roller being slidably disposed in said axially-extending guide slot in said guide sleeve so as to permit axial sliding movement of said cam follower roller and bulb carrier sleeve and light bulb member relative to said guide sleeve;

a switch housing mounted within said casing;

a conductor strip mounted within said switch housing;

an outer coiled compression spring disposed between said switch housing and said light bulb member for urging said light bulb member forwardly in said central opening of said reflector structure; said cam follower roller on said bulb carrier sleeve in which said light bulb member is mounted functioning, in conjunction with said guide slot in said guide sleeve, to define the forward and rearward limits of axial movement of said light bulb structure; an exterior guide sleeve disposed within said coiled compression spring; said exterior guide sleeve having a forward end disposed adjacent to said light bulb member and a rear end portion disposed adjacent to said switch housing;

a contact member secured in said rear end portion of said exterior guide sleeve;

an interior guide sleeve slidably disposed within said exterior guide sleeve; said interior guide sleeve having a forward end portion and a rear end portion;

a contact element secured in said forward end portion of said interior guide sleeve; said conductive contact element being adapted to receive a contact portion of said light bulb structure;

an interior compression spring disposed within said interior guide sleeve and extending between said contact member in the rear end portion of said guide sleeve and said contact element in the forward end portion of said interior guide sleeve to establish electrical contact between said conductor strip in said switch housing and said light bulb member.

3. In a flashlight comprising a casing having a longitudinal axis and a forward end, a reflector disposed adjacent the forward end of said casing, said reflector having a central opening therein, a light bulb support structure disposed rearwardly of said reflector, a light bulb releasably retained in said light bulb support structure, said light bulb extending through said central opening, and means for creating relative movement between said reflector and said light bulb to selectively vary the breadth of the light beam issuing from said flashlight, the improvement comprising:

a reflector support structure rotatably mounted on said casing adjacent said forward end thereof;

means connecting said reflector to said reflector support structure for rotation therewith;

means mounting said light bulb support structure within said casing for axial movement relative to said reflector support structure; spring means, normally urging said light bulb and said light bulb support structure forwardly in said casing;

cooperating camming means connected to said reflector and said light bulb support structure for moving said light bulb support structure axially in response to rotational movement of said reflector;

said cooperating camming means including an inclined camming surface connected to said reflector and a cam follower connected to said light bulb support structure;

whereby, rotation of said reflector support structure will cause rotation of said reflector which is connected thereto, and rotation of said reflector will, by virtue of said cooperating camming means and said spring means, cause axial movement of said light bulb support structure and said light bulb retained thereby to alter the breadth of the light beam issuing from said flashlight;

a pair of spaced conductor strips disposed within said casing, and a switching structure for selectively establishing electrical connection between said spaced conductor strips; and means establishing electrical connection between one of said conductor strips and said light bulb; said other of said conductor strips being adapted to electrically contact batteries disposed in said casing; said switch structure including:

a drive plunger and an indexing member;

said drive plunger and said indexing member having cooperating surfaces, whereby movement of said drive plunger toward said indexing member will tend to cause rotation of said indexing member;

a bridging contact carried by said indexing member; said bridging contact being adapted to establish an electrical flow path from one of said conductor strips to the other; means for preventing rotational movement of said indexing member until said drive plunger has moved said indexing member so as to engage said bridging contact with each of said conductor strips; said means thereafter permitting said cooperating teeth on said drive plunger and said indexing member to cause rotational movement of said indexing member so as to cause said engaged surface portions of said bridging contact and said spaced conductor strips to wipe any products of oxidation or corrosion therefrom.

4. A flashlight according to claim 3, and further comprising a guide body in which said drive plunger is disposed; said guide body including an internal peripheral wall; and circumferentially-spaced grooves in said internal peripheral wall for confining movement of said drive plunger to sliding movement and for preventing rotational movement of said drive plunger.

5. A flashlight according to claim 4, and further including inclined ramp surface means in said guide body on the internal peripheral wall thereof; said indexing member having teeth riding within grooves in said internal peripheral wall of said guide body until said drive plunger has moved said indexing member sufficiently to clear said inclined ramp surface means, whereupon continued movement of said drive plunger against said indexing member will cause said indexing member to rotate, causing rotation of said bridging contact against the surface portions of said pair of conductor strips.

* * * * *